US008176743B2

(12) United States Patent
Kurihara et al.

(10) Patent No.: US 8,176,743 B2
(45) Date of Patent: May 15, 2012

(54) REFRIGERATION DEVICE

(75) Inventors: Toshiyuki Kurihara, Sakai (JP); Shinichi Kasahara, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 598 days.

(21) Appl. No.: 12/439,934

(22) PCT Filed: Aug. 28, 2007

(86) PCT No.: PCT/JP2007/066617

§ 371 (c)(1),
(2), (4) Date: Mar. 4, 2009

(87) PCT Pub. No.: WO2008/032558

PCT Pub. Date: Mar. 20, 2008

(65) Prior Publication Data

US 2010/0050672 A1 Mar. 4, 2010

(30) Foreign Application Priority Data

Sep. 11, 2006 (JP) ..... 2006-246151

(51) Int. Cl.
*F25B 41/04* (2006.01)
*F25D 17/06* (2006.01)

(52) U.S. Cl. ..... 62/205; 62/190

(58) Field of Classification Search ..... 62/190, 62/205, 210, 222, 509, 513
See application file for complete search history.

(56) References Cited

U.S. PATENT DOCUMENTS

| | | | | |
|---|---|---|---|---|
| 6,044,655 | A * | 4/2000 | Ozaki et al. | 62/205 |
| 2005/0132729 | A1 * | 6/2005 | Manole | 62/149 |
| 2010/0180612 | A1 * | 7/2010 | Kasahara et al. | 62/225 |

FOREIGN PATENT DOCUMENTS

| | | | |
|---|---|---|---|
| JP | 10-115470 | A | 5/1998 |
| JP | 11-142007 | A | 5/1999 |
| JP | 2001-133058 | A | 5/2001 |
| JP | 2001133058 | A * | 5/2001 |
| JP | 2003-4316 | A | 1/2003 |
| JP | 2005-214443 | A | 8/2005 |
| JP | 2005214443 | A * | 8/2005 |

OTHER PUBLICATIONS

Office Action of corresponding Japanese Application No. 2006-246151 dated Jul. 19, 2011.

* cited by examiner

*Primary Examiner* — Chen Wen Jiang
(74) *Attorney, Agent, or Firm* — Global IP Counselors

(57) ABSTRACT

A refrigeration device includes a control unit, and a refrigerant circuit in which a compression mechanism, a radiator, a refrigerant cooling unit, a first expansion mechanism, a liquid receiver, a second expansion mechanism, and an evaporator are connected in sequence. The control unit performs refrigerant cooling control whereby the refrigerant is cooled by the refrigerant cooling unit so that the state of the refrigerant that has flowed out from the first expansion mechanism is near the saturation line and not near the critical point.

4 Claims, 6 Drawing Sheets

REFRIGERATION DEVICE

CROSS-REFERENCE TO RELATED APPLICATIONS

This U.S. National stage application claims priority under 35 U.S.C. §119(a) to Japanese Patent Application No. 2006-246151, filed in Japan on Sep. 11, 2006, the entire contents of which are hereby incorporated herein by reference.

TECHNICAL FIELD

The present invention relates to a refrigeration device, and particularly relates to a refrigeration device in which the refrigerant attains a supercritical state during the refrigeration cycle.

BACKGROUND ART

Conventional refrigeration devices are widely known that are provided with a refrigerant circuit in which a compressor, a radiator, a supercooler, a first expansion valve, a liquid receiver, a second expansion valve, and an evaporator are connected in sequence (see Japanese Laid-open Patent Application No. 10-115470, page 5, right column, line 40 through page 6, left column, line 45 and FIG. 8, for example).

SUMMARY OF THE INVENTION

Technical Problem

In the refrigerant circuit of such a refrigeration device, when the refrigerant is expanded by the first expansion valve to a state near the saturation line, depending on the installation environment (e.g., a case such as overload during summer), the refrigerant sometimes reaches a state near the critical point. When the refrigerant reaches a state near the critical point in this manner, not only is there a risk of cavitation and adverse effects on the constituent parts described above, but the fluid level of the refrigerant in the liquid receiver becomes difficult to control, and it can become impossible to maintain an appropriate amount of refrigerant in the refrigerant circuit.

An object of the present invention is to prevent the refrigerant from reaching a state near the critical point when the refrigerant is expanded to a state near the saturation line by the first expansion valve or the like in a refrigerant device such as described above.

Solution to Problem

A refrigeration device according to a first aspect of the present invention comprises a compression mechanism, a radiator, a first expansion mechanism, a refrigerant cooling unit, a liquid receiver, a second expansion mechanism, an evaporator, and a control unit. The compression mechanism compresses a refrigerant. The radiator is connected to a refrigerant discharge side of the compression mechanism. The first expansion mechanism is connected to an exit side of the radiator. The refrigerant cooling unit is disposed between the exit side of the radiator and a refrigerant inflow side of the first expansion mechanism. The liquid receiver is connected to a refrigerant outflow side of the first expansion mechanism. The second expansion mechanism is connected to an exit side of the liquid receiver. The evaporator is connected to a refrigerant outflow side of the second expansion mechanism and to a refrigerant intake side of the compression mechanism. The control unit performs refrigerant cooling control whereby the refrigerant is cooled by the refrigerant cooling unit so that the state of the refrigerant that has flowed out from the first expansion mechanism is near the saturation line and not near the critical point.

In this refrigeration device, the control unit performs refrigerant cooling control whereby the refrigerant is cooled by the refrigerant cooling unit so that the state of the refrigerant that has flowed out from the first expansion mechanism is near the saturation line and not near the critical point. It is therefore possible to prevent the refrigerant from reaching a state near the critical point when the refrigerant is expanded to a state near the saturation line by the first expansion mechanism in the refrigeration device.

A refrigeration device according to a second aspect of the present invention is the refrigeration device according to the first aspect of the present invention, wherein the refrigerant cooling unit is an internal heat exchanger for exchanging heat between refrigerant that flows to a first refrigerant pipe connecting the exit side of the radiator and the inflow side of the first expansion mechanism, and refrigerant that flows to a second refrigerant pipe connecting the exit side of the evaporator and the refrigerant intake side of the compression mechanism. The first expansion mechanism and the second expansion mechanism are controlled in the refrigerant cooling control so that state of the refrigerant that has flowed out from the first expansion mechanism is near the saturation line and not near the critical point.

In this refrigeration device, the refrigerant cooling unit is an internal heat exchanger. In refrigerant cooling control, the first expansion mechanism and the second expansion mechanism are controlled so that the state of the refrigerant that has flowed out from the first expansion mechanism is near the saturation line and not near the critical point. Therefore, in this refrigeration device, it is possible to prevent the refrigerant from reaching a state near the critical point when the refrigerant is expanded to a state near the saturation line by the first expansion mechanism. There is also no need for a chiller or other external cooling device, and the manufacturing cost can therefore be kept low.

A refrigeration device according to a third aspect of the present invention is the refrigeration device according to the first or second aspect of the present invention, wherein the refrigerant is cooled by the refrigerant cooling unit in the refrigerant cooling control so that the refrigerant that has flowed out from the first expansion mechanism is in a state near the saturation line and the pressure of the refrigerant is equal to or less than a pressure of {critical pressure (MPa)−0.3 (MPa)}.

In refrigerant cooling control in this refrigeration device, the refrigerant is cooled by the refrigerant cooling unit so that the refrigerant that has flowed out from the first expansion mechanism is in a state near the saturation line and the pressure of the refrigerant is equal to or less than a pressure of {critical pressure (MPa)−0.3 (MPa)}. Therefore, in this refrigeration device, it is possible to prevent the refrigerant from reaching a state near the critical point when the refrigerant is expanded to a state near the saturation line by the first expansion mechanism.

A refrigeration device according to a fourth aspect of the present invention is the refrigeration device according to the third aspect of the present invention, further comprising a temperature detector. The temperature detector is provided in the vicinity of the exit of the radiator, or in the vicinity of a refrigerant inflow port of the first expansion mechanism. In refrigerant cooling control, the refrigerant is cooled by the refrigerant cooling unit so that the refrigerant that has flowed out from the first expansion mechanism is in a state near the saturation line and the pressure of the refrigerant is equal to or less than a pressure of {critical pressure (MPa)−0.3 (MPa)} when the temperature detected by the temperature detector is equal to or above a predetermined temperature.

In refrigerant cooling control in this refrigeration device, the refrigerant is cooled by the refrigerant cooling unit so that the refrigerant that has flowed out from the first expansion mechanism is in a state near the saturation line and the pressure of the refrigerant is equal to or less than a pressure of {critical pressure (MPa)−0.3 (MPa)} when the temperature detected by the temperature detector is equal to or above a predetermined temperature. Therefore, in this refrigeration device, it is possible to prevent the refrigerant from reaching a state near the critical point when the refrigerant is expanded to a state near the saturation line by the first expansion mechanism and there is a risk of the refrigerant reaching a state near the critical point.

A refrigeration device according to a fifth aspect of the present invention is the refrigeration device according to any of the first through fourth aspects of the present invention, wherein the control unit has control switching section (means). The term "normal control" refers to control that gives priority to COP, for example, and other control. The control switching means switches between the refrigerant cooling control and the normal control.

In this refrigeration device, the control switching means switches between the refrigerant cooling control and the normal control. It is therefore possible to execute control that takes COP into account in the refrigeration device.

Advantageous Effects of Invention

In the refrigeration device according to the first through third aspects of the present invention, it is possible to prevent the refrigerant from reaching a state near the critical point when the refrigerant is expanded to a state near the saturation line by the first expansion mechanism.

In the refrigeration device according to the fourth aspect of the present invention, it is possible to prevent the refrigerant from reaching a state near the critical point when the refrigerant is expanded to a state near the saturation line by the first expansion mechanism and there is a risk of the refrigerant reaching a state near the critical point.

In the refrigeration device according to the fifth aspect of the present invention, it is possible to execute control that takes COP into account.

DETAILED DESCRIPTION OF THE INVENTION

<Structure of Air Conditioning Device>

Figure 1:
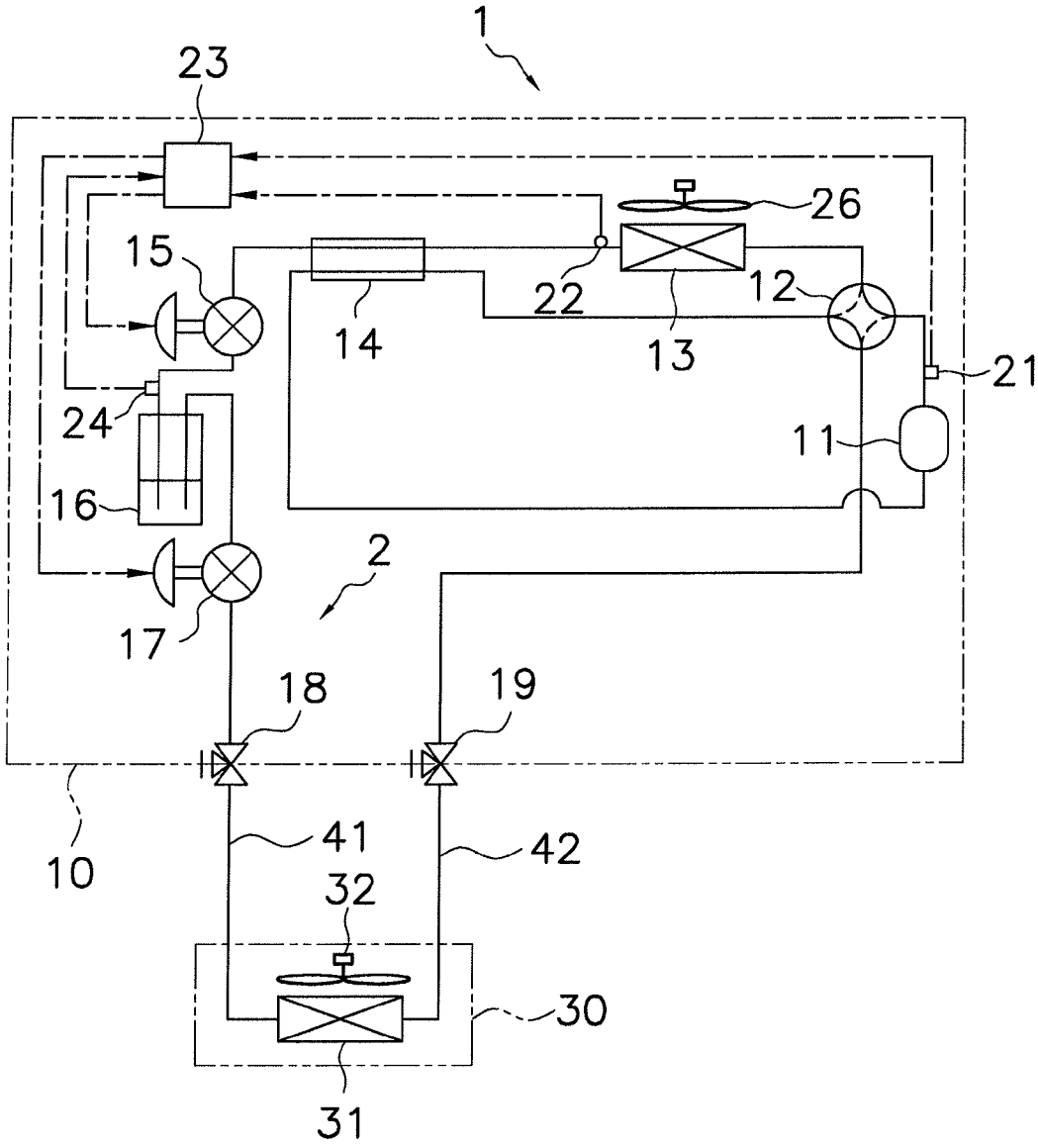
FIG. 1 is a diagram showing the refrigerant circuit of an air conditioning device according to an embodiment of the present invention.

FIG. 1 is a schematic view of the refrigerant circuit 2 of the air conditioning device 1 according to an embodiment of the present invention.

This air conditioning device 1 is an air conditioning device that is capable of cooling operation and heating operation using carbon dioxide as the refrigerant, and is primarily composed of a refrigerant circuit 2, blower fans 26, 32, a control device 23, a high-pressure sensor 21, a temperature sensor 22, an intermediate-pressure sensor 24, and other components.

The refrigerant circuit 2 is equipped primarily with a compressor 11, a four-way switch valve 12, an outdoor heat exchanger 13, an internal heat exchanger 14, a first electric expansion valve 15, a liquid receiver 16, a second electric expansion valve 17, and an indoor heat exchanger 31, and the devices are connected via a refrigerant pipe, as shown in FIG. 1.

In the present embodiment, the air conditioning device 1 is a separate-type air conditioning device, and can also be described as comprising an indoor unit 30 primarily having the indoor heat exchanger 31 and an indoor fan 32; an outdoor unit 10 primarily having the compressor 11, the four-way switch valve 12, the outdoor heat exchanger 13, the internal heat exchanger 14, the first electric expansion valve 15, the liquid receiver 16, the second electric expansion valve 17, the high-pressure sensor 21, the temperature sensor 22, and the control device 23; a first connecting pipe 41 for connecting the pipe for refrigerant fluid and the like of the indoor unit 30 and the pipe for refrigerant fluid and the like of the outdoor unit 10; and a second connecting pipe 42 for connecting the pipe for refrigerant gas and the like of the indoor unit 30 and the pipe for refrigerant gas and the like of the outdoor unit 10. The first connecting pipe 41 and the pipe for refrigerant fluid and the like of the outdoor unit 10 are connected via a first close valve 18 of the Outdoor unit 10, and the second connecting duct 42 and the pipe for refrigerant gas and the like of the outdoor unit 10 are connected via a second close valve 19 of the outdoor unit 10.

(1) Indoor Unit

The indoor unit 30 primarily has the indoor heat exchanger 31, the indoor fan 32, and other components.

The indoor heat exchanger 31 is a heat exchanger for exchanging heat between the refrigerant and the indoor air, which is the air inside the room to be air-conditioned.

The indoor fan 32 is a fan for taking the air inside the air-conditioned room into the unit 30 and blowing conditioned air, which is the air after heat exchange with the refrigerant via the indoor heat exchanger 31, back into the air-conditioned room.

Employing such a configuration makes it possible for the indoor unit 30 to cause heat to be exchanged between the indoor air taken in by the indoor fan 32 and the liquid refrigerant that flows through the indoor heat exchanger 31, and generate conditioned air (cool air) during cooling operation, as well as to cause heat to be exchanged between the indoor air taken in by the indoor fan 32 and supercritical refrigerant that flows through the indoor heat exchanger 31, and generate conditioned air (warm air) during heating operation.

(2) Outdoor Unit

The outdoor unit 10 primarily has the compressor 11, the four-way switch valve 12, the outdoor heat exchanger 13, the internal heat exchanger 14, the first electric expansion valve 15, the liquid receiver 16, the second electric expansion valve 17, an outdoor fan 26, the control device 23, the high-pressure sensor 21, the temperature sensor 22, the intermediate-pressure sensor 24, and other components.

The compressor 11 is a device for drawing in low-pressure refrigerant gas flowing through an intake pipe and compressing the refrigerant gas to a supercritical state, and then discharging the refrigerant to a discharge pipe.

The four-way switch valve 12 is a valve for switching the flow direction of the refrigerant in accordance with each operation mode, and is capable of connecting the discharge side of the compressor 11 and the high-temperature side of the outdoor heat exchanger 13, and connecting the intake side of the compressor 11 and the gas side of the indoor heat exchanger 31 via the internal heat exchanger 14 during cooling operation; as well as connecting the discharge side of the compressor 11 and the second close valve 19 via the internal heat exchanger 14, and connecting the intake side of the compressor 11 and the gas side of the outdoor heat exchanger 13 during heating operation.

The outdoor heat exchanger 13 is capable of cooling the high-pressure supercritical refrigerant discharged from the compressor 11 using the air outside the air-conditioned room as a heat source during cooling operation, and evaporating the liquid refrigerant returning from the indoor heat exchanger 31 during heating operation.

The internal heat exchanger 14 is a heat exchanger formed by placing close to each other the refrigerant pipe (hereinafter referred to as the tenth refrigerant pipe) for connecting the first electric expansion valve 15 and the low-temperature side (or liquid side) of the outdoor heat exchanger 13, and the refrigerant pipe (hereinafter referred to as the eleventh refrigerant duct) for connecting the four-way switch valve 12 and the compressor 11. In the internal heat exchanger 14, heat is exchanged between the high-temperature high-pressure supercritical refrigerant flowing through the tenth refrigerant duct, and the low-temperature low-pressure refrigerant gas flowing through the eleventh refrigerant duct during cooling operation.

The first electric expansion valve 15 reduces the pressure of the supercritical refrigerant (during cooling operation) that flows out from the low-temperature side of the outdoor heat exchanger 13, or the liquid refrigerant (during heating operation) that flows in through the liquid receiver 16.

The liquid receiver 16 stores refrigerant that occurs as excess depending on the operating mode or the air conditioning load.

The second electric expansion valve 17 reduces the pressure of the liquid refrigerant (during cooling operation) that flows in through the liquid receiver 16, or the supercritical refrigerant (during heating operation) that flows out from the low-temperature side of the indoor heat exchanger 31.

The outdoor fan 26 is a fan for taking the outdoor air into the unit 10 and discharging the air after heat exchange with the refrigerant via the outdoor heat exchanger 13.

The high-pressure sensor 21 is provided to the discharge side of the compressor 11.

The temperature sensor 22 is provided in the vicinity of the low-temperature side (or liquid side) of the outdoor heat exchanger 13.

The intermediate-pressure sensor 24 is provided between the first electric expansion valve 15 and the liquid receiver 16.

Figure 2:
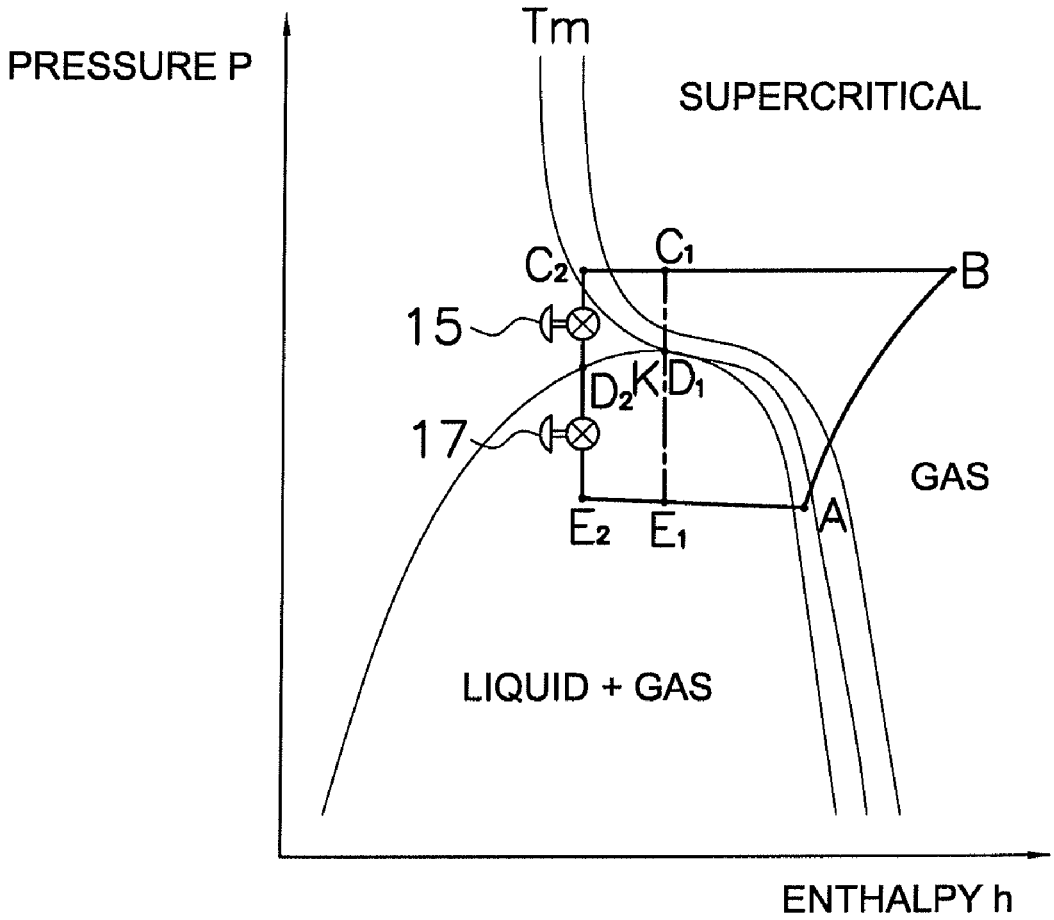
FIG. 2 is a diagram showing refrigerant cooling control by the control device of the air conditioning device according to an embodiment of the present invention.

The control device 23 has a communication connection with the high-pressure sensor 21, the temperature sensor 22, the intermediate-pressure sensor 24, the first electric expansion valve 15, the second electric expansion valve 17, and other components, and controls the degree of opening of the first electric expansion valve 15 and the second electric expansion valve 17 on the basis of temperature information transmitted from the temperature sensor 22, high-pressure information transmitted from the high-pressure sensor 21, and intermediate-pressure information transmitted from the intermediate-pressure sensor 24. The control device 23 is also provided with control switching functionality (i.e., a control switching section or means) for switching between normal control and refrigerant cooling control on the basis of temperature information and high-pressure information during cooling operation. In normal control, the degree of opening of the first electric expansion valve 15 and the second electric expansion valve 17 is controlled so that COP or the like is enhanced. In refrigerant cooling control, the degree of opening of the first electric expansion valve 15 and the second electric expansion valve 17 is controlled so that the state of the refrigerant that has flowed out from the first electric expansion valve 15 is on the saturation line and not near the critical point, and the state of the refrigerant in the liquid receiver 16 is maintained at saturation. The refrigerant cooling control will be described in detail using a Mollier diagram. FIG. 2 shows the refrigeration cycle of the air conditioning device 1 according to the present embodiment on a Mollier diagram for carbon dioxide. In FIG. 2, A→B indicates the compression stroke, $B \rightarrow C_1$, $C_2$ indicates the cooling stroke (wherein $B \rightarrow C_1$ is cooling by the outdoor heat exchanger 13, and $C_1 \rightarrow C_2$ is cooling by the internal heat exchanger), $C_1$, $C_2 \rightarrow D_1$, $D_2$ indicates the first expansion stroke (pressure reduction by the first electric expansion valve 15), $D_1$, $D_2 \rightarrow E_1$, $E_2$ indicates the second expansion stroke (pressure reduction by the second electric expansion valve 17), and $E_1$, $E_2 \rightarrow A$ indicates the evaporation stroke. Also, K indicates the critical point (in FIG. 2, point K and point $D_1$ overlap), and Tm is the isothermal line. According to the refrigeration cycle of $A \rightarrow B \rightarrow C_1 \rightarrow D_1(K) \rightarrow E_1 \rightarrow A$, the refrigerant that has flowed out from the first electric expansion valve 15 is in a state near the critical point. However, since the high-pressure sensor 21 is disposed on the discharge side of the compressor 11, and the temperature sensor 22 is disposed in the vicinity of the low-temperature side of the outdoor heat exchanger 13 in the air conditioning device 1 of the present embodiment, it is possible to detect that the refrigerant that has flowed out from the first electric expansion valve 15 has reached the state of point $C_1$. Therefore, when the refrigerant that has flowed out from the first electric expansion valve 15 is detected reaching the state of point $C_1$ in this air conditioning device 1, the degree of opening of the first electric expansion valve 15 and the second electric expansion valve 17 is appropriately adjusted and the refrigerant that has flowed out from the first electric expansion valve 15 is cooled to the state of point $C_2$. The refrigeration cycle is thereby changed to the refrigeration cycle of $A \rightarrow B \rightarrow C_2 \rightarrow D_2 \rightarrow E_2 \rightarrow A$. In other words, since the refrigerant is cooled to the state of point $C_2$, the refrigerant can be placed in a state near the saturation line and not near the critical point. In the present embodiment, the control device 23 controls the first electric expansion valve 15 and the second electric expansion valve 17 so that the pressure indicated by the intermediate-pressure sensor 24 is equal to or lower than the pressure of {critical pressure (MPa) −0.3 (MPa)}. The pressure of {critical pressure (MPa) −0.3 (MPa)} is determined in the following manner. The results of tests performed by the inventors show that the pressure (hereinafter referred to as the intermediate pressure) between the first electric expansion valve 15 and the second electric expansion valve 17 can be controlled to within a range of about ±0.1 MPa from the target value in the case of the refrigerant. In order to prevent the intermediate pressure from coming near the critical point, the target value of the intermediate pressure is preferably the critical pressure (MPa) −0.3 (MPa), with a safety factor of 3.

In the present embodiment, normal control is automatically performed when there is no need for refrigerant cooling control.

<Operation of the Air Conditioning Device>

The operation of the air conditioning device 1 will be described using FIG. 1. This air conditioning device 1 is capable of cooling operation and heating operation, as described above.

(1) Cooling Operation

During cooling operation, the four-way switch valve 12 is in the state indicated by the solid line in FIG. 1, i.e., a state in which the discharge side of the compressor 11 is connected to the high-temperature side of the outdoor heat exchanger 13, and the intake side of the compressor 11 is connected to the second close valve 19 via the internal heat exchanger 14. The first close valve 18 and the second close valve 19 are also open at this time.

When the compressor 11 is activated in this state of the refrigerant circuit 2, the refrigerant gas is sucked into the compressor 11 and compressed to a supercritical state, and then sent through the four-way switch valve 12 to the outdoor heat exchanger 13 and cooled in the outdoor heat exchanger 13.

This cooled supercritical refrigerant is sent to the first electric expansion valve 15 via the internal heat exchanger 14. At this time, the supercritical refrigerant is cooled by the low-temperature refrigerant gas flowing through the eleventh refrigerant pipe of the internal heat exchanger 14. The supercritical refrigerant sent to the first electric expansion valve 15 is depressurized to a saturated state, and then sent to the second electric expansion valve 17 via the liquid receiver 16. The refrigerant in a saturated state sent to the second electric expansion valve 17 is depressurized to liquid refrigerant, and then fed to the indoor heat exchanger 31 via the first close valve 18, where the refrigerant cools the indoor air and evaporates into refrigerant gas.

The refrigerant gas is again sucked into the compressor 11 via the second close valve 19, the internal heat exchanger 14, and the four-way switch valve 12. At this time, the refrigerant gas is heated by the high-temperature supercritical refrigerant flowing through the tenth refrigerant pipe of the internal heat exchanger 14. Cooling operation is performed in this manner. At this time, the control device 23 appropriately switches between normal control and refrigerant cooling control on the basis of temperature information and high-pressure information as described above.

(2) Heating Operation

During heating operation, the four-way switch valve 12 is in the state indicated by the dashed line in FIG. 1, i.e., a state in which the discharge side of the compressor 11 is connected to the second close valve 19, and the intake side of the compressor 11 is connected to the gas side of the outdoor heat exchanger 13 via the internal heat exchanger 14. The first close valve 18 and the second close valve 19 are also open at this time.

When the compressor 11 is activated in this state of the refrigerant circuit 2, the refrigerant gas is sucked into the compressor 11 and compressed to a supercritical state, and then is fed to the indoor heat exchanger 31 via the four-way switch valve 12 and the second close valve 19.

The supercritical refrigerant heats the indoor air, and is cooled in the indoor heat exchanger 31. The cooled supercritical refrigerant is sent through the first close valve to the second electric expansion valve 17. The supercritical refrigerant sent to the second electric expansion valve 17 is depressurized to a saturated state, and then sent to the first electric expansion valve 15 via the liquid receiver 16. The refrigerant in a saturated state sent to the first electric expansion valve 15 is depressurized to liquid refrigerant, and then sent to the outdoor heat exchanger 13 via the internal heat exchanger 14 and evaporated to refrigerant gas in the outdoor heat exchanger 13. At this time, the refrigerant gas is heated by the high-temperature supercritical refrigerant that flows to the eleventh refrigerant pipe of the internal heat exchanger 14. This refrigerant gas is again sucked into the compressor 11 via the four-way switch valve 12. Heating operation is performed in this manner.

<Characteristics of the Air Conditioning Device>

(1)

In the air conditioning device 1 according to the present embodiment, the first electric expansion valve 15 and the second electric expansion valve 17 are controlled so that the state of the refrigerant that has flowed out from the first electric expansion valve 15 is on the saturation line, and so that the pressure of the refrigerant at this time is equal to or lower than the pressure of {critical pressure (MPa)−0.3 (MPa)}. It is therefore possible to prevent the refrigerant from reaching a state near the critical point when the refrigerant is expanded to a state near the saturation line by the first electric expansion valve 15 in the air conditioning device 1.

(2)

In the air conditioning device 1 according to the present embodiment, the control device 23 is provided with functionality for switching between refrigerant cooling control and normal control. It is therefore possible to execute control that takes COP into account in the air conditioning device 1.

<Modifications>

(A)

Figure 3:
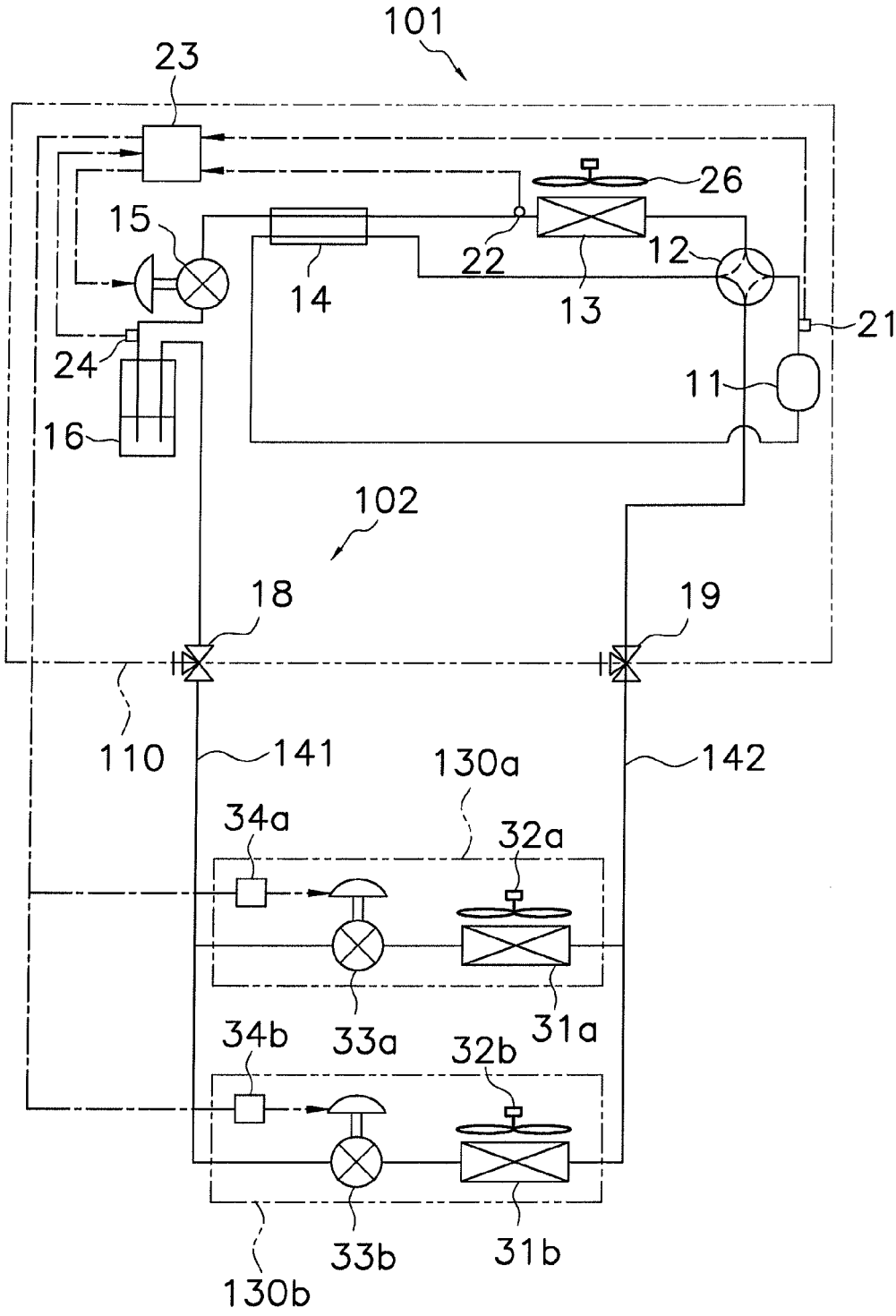
FIG. 3 is a diagram showing the refrigerant circuit of the air conditioning device according to Modification (A).

In the embodiment described above, the invention of the present application is applied to a separate-type air conditioning device 1 in which one indoor unit 30 is provided for one outdoor unit 10, but the invention of the present application may also be applied to a multi-type air conditioning device 101 in which a plurality of indoor units is provided for one outdoor unit, such as the one shown in FIG. 3. In FIG. 3, the same reference numerals are used to refer to components that are the same as those of the air conditioning device 1 according to the embodiment described above. In FIG. 3, the reference numeral 102 refers to a refrigerant circuit, 110 refers to an outdoor unit, 130*a* and 130*b* refer to indoor units, 31*a* and 31*b* refer to indoor heat exchangers, 32*a* and 32*b* refer to indoor fans, 33*a* and 33*b* refer to second electric expansion valves, 34*a* and 34*b* refer to indoor control devices, and 141 and 142 refer to connecting pipes. In this case, the control device 23 controls the second electric expansion valves 33*a*, 33*b* via the indoor control devices 34*a*, 34*b*. The second electric expansion valves 33*a*, 33*b* are housed in the indoor units 130*a*, 130*b* in the present modification, but the second electric expansion valves 33*a*, 33*b* may also be housed in the outdoor unit 110.

(B)

An internal heat exchanger 14 in which the tenth refrigerant pipe and the eleventh refrigerant pipe are placed close to each other is used in the air conditioning device 1 according to the embodiment described above, but a dual-pipe heat exchanger may also be used as the internal heat exchanger.

(C)

Figure 4:
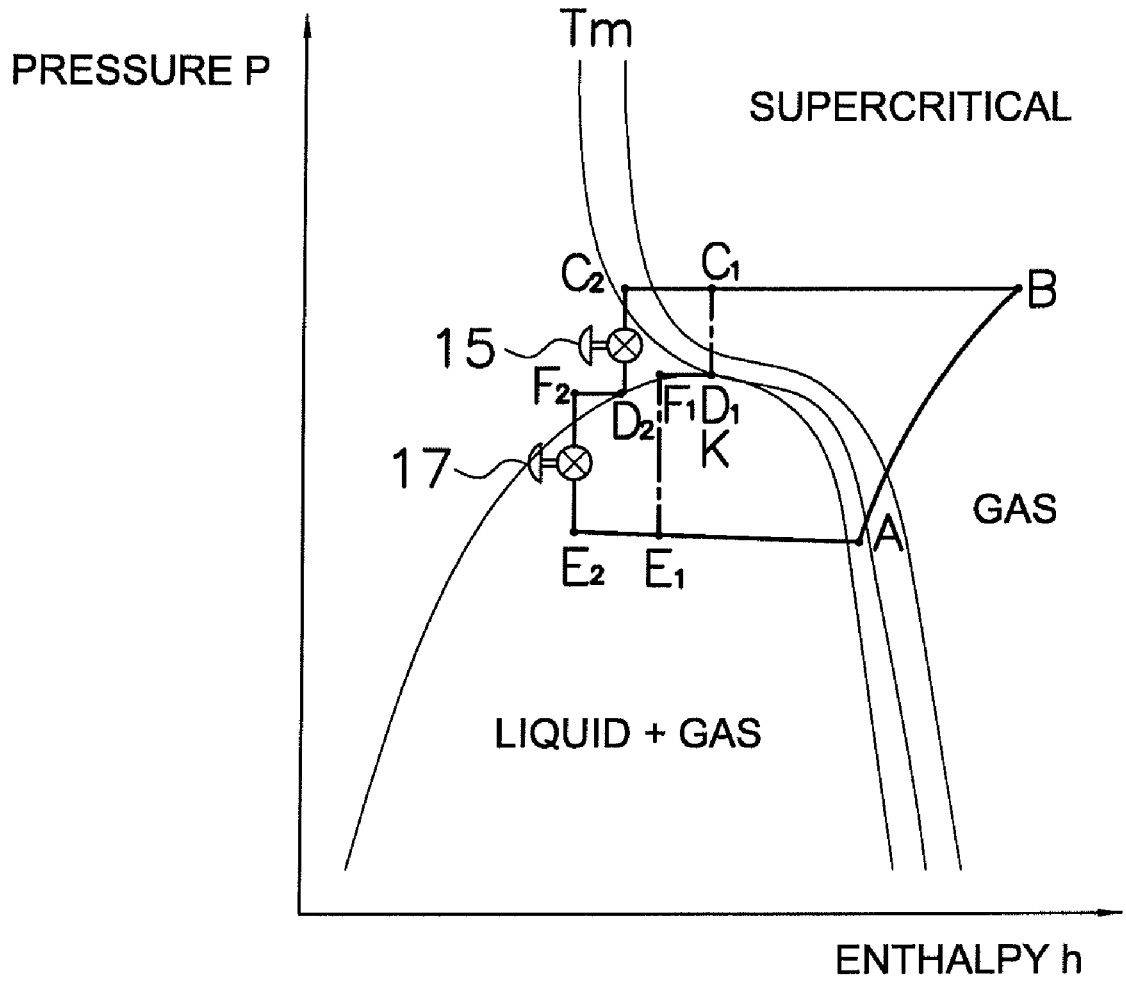
FIG. 4 is a diagram showing refrigerant cooling control by the control device of the air conditioning device according to Modification (C).

In the air conditioning device 1 according to the embodiment described above, although not particularly mentioned in the above description, a supercooling heat exchanger (which may be an internal heat exchanger) may be provided between the liquid receiver 16 and the second electric expansion valve 17. In this case, the refrigeration cycle on the Mollier diagram is as shown in FIG. 4. In FIG. 4, A→B indicates the compression stroke, $B \rightarrow C_1$, $C_2$ indicates the first cooling stroke, $C_1$, $C_2 \rightarrow D_1$, $D_2$ indicates the first expansion stroke, $D_1$, $D_2 \rightarrow F_1$, $F_2$ indicates the second cooling stroke (cooling by the supercooling heat exchanger), $F_1$, $F_2 \rightarrow E_1$, $E_2$ indicates the second expansion stroke, and $E_1$, $E_2 \rightarrow A$ indicates the evaporation stroke.

(D)

Figure 5:
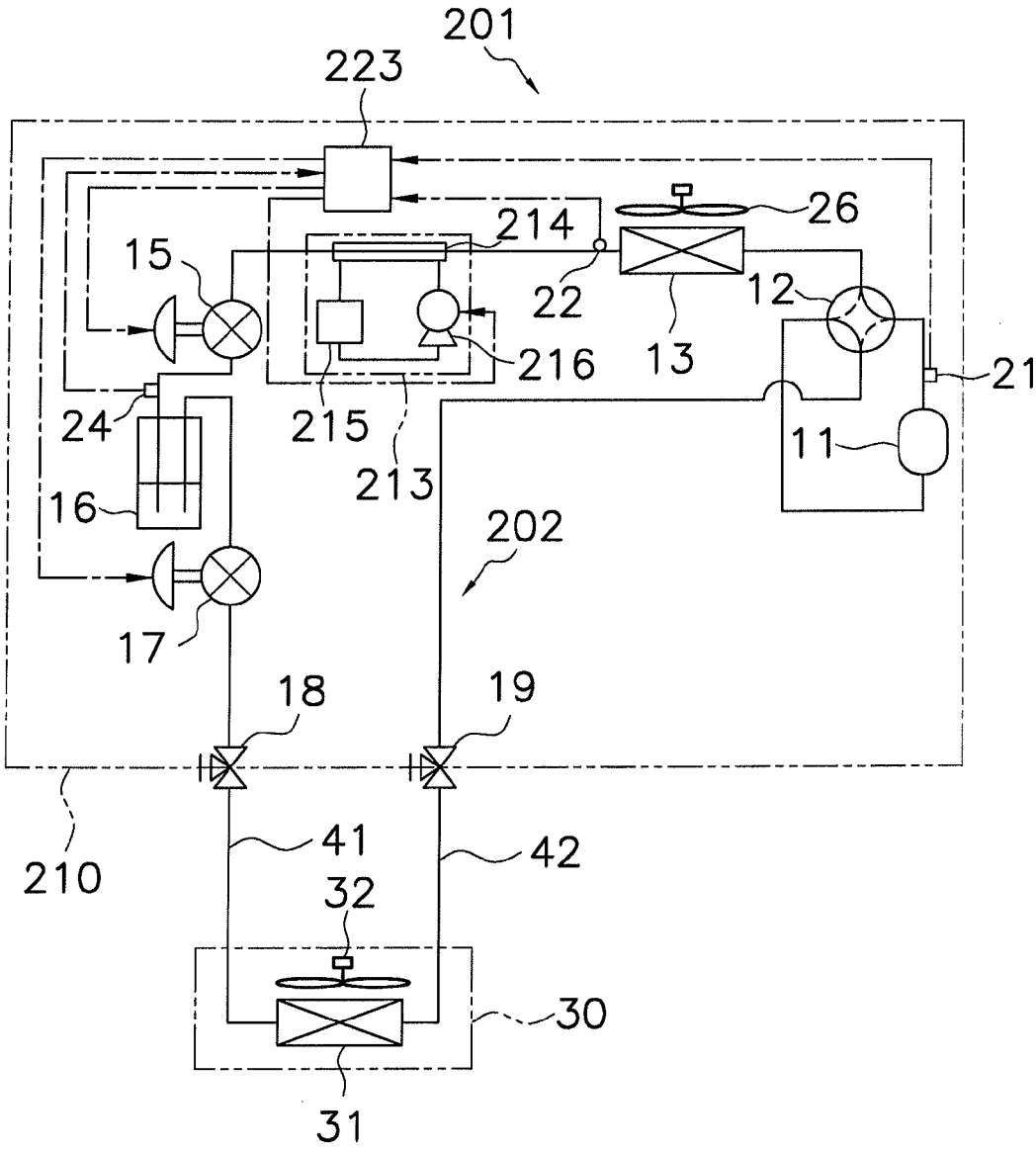
FIG. 5 is a diagram showing the refrigerant circuit of the (separate-type) air conditioning device according to Modification (D).

The internal heat exchanger 14 is formed between the first electric expansion valve 15 and the low-temperature side (or liquid side) of the outdoor heat exchanger 13 in the air conditioning device 1 according to the embodiment described above, but a configuration may instead be adopted in which an external cooling device 213 such as the one shown in FIG. 5 is attached to the tenth refrigerant pipe. This external cooling device 213 is primarily composed of a cooling tube 214, a chiller 215, and a liquid pump 216. The cooling tube 214 surrounds the tenth refrigerant pipe. The chiller 215 cools the refrigerant (e.g., water or the like) that flows through the cooling tube. The liquid pump 216 pumps the refrigerant cooled by the chiller 215 to the cooling tube 214. The refrigerant that flows into the cooling tube 214 is returned to the chiller 215 and cooled by the chiller 215 (i.e., the refrigerant is circulated). The chiller 215 maintains the refrigerant always at a constant temperature. In this case, in refrigerant cooling control, when the refrigerant that has flowed out from the first electric expansion valve 15 is determined to have reached a state near the critical point, a control device 223 activates the liquid pump 216 or increases the pumping rate of the liquid pump 216, and ensures that the state of the refrigerant that has flowed out from the first electric expansion valve 15 reaches a state on the saturation line, and that the pressure of the refrigerant is then equal to or lower than the pressure of {critical pressure (MPa)−0.3 (MPa)}. In this instance, the pumping rate of the liquid pump 216 may be kept constant, and the control device 223 may increase the cooling ability of the chiller 215, or the control device 223 may simultaneously increase the pumping rate of the liquid pump 216 and the cooling ability of the chiller 215.

Figure 6:
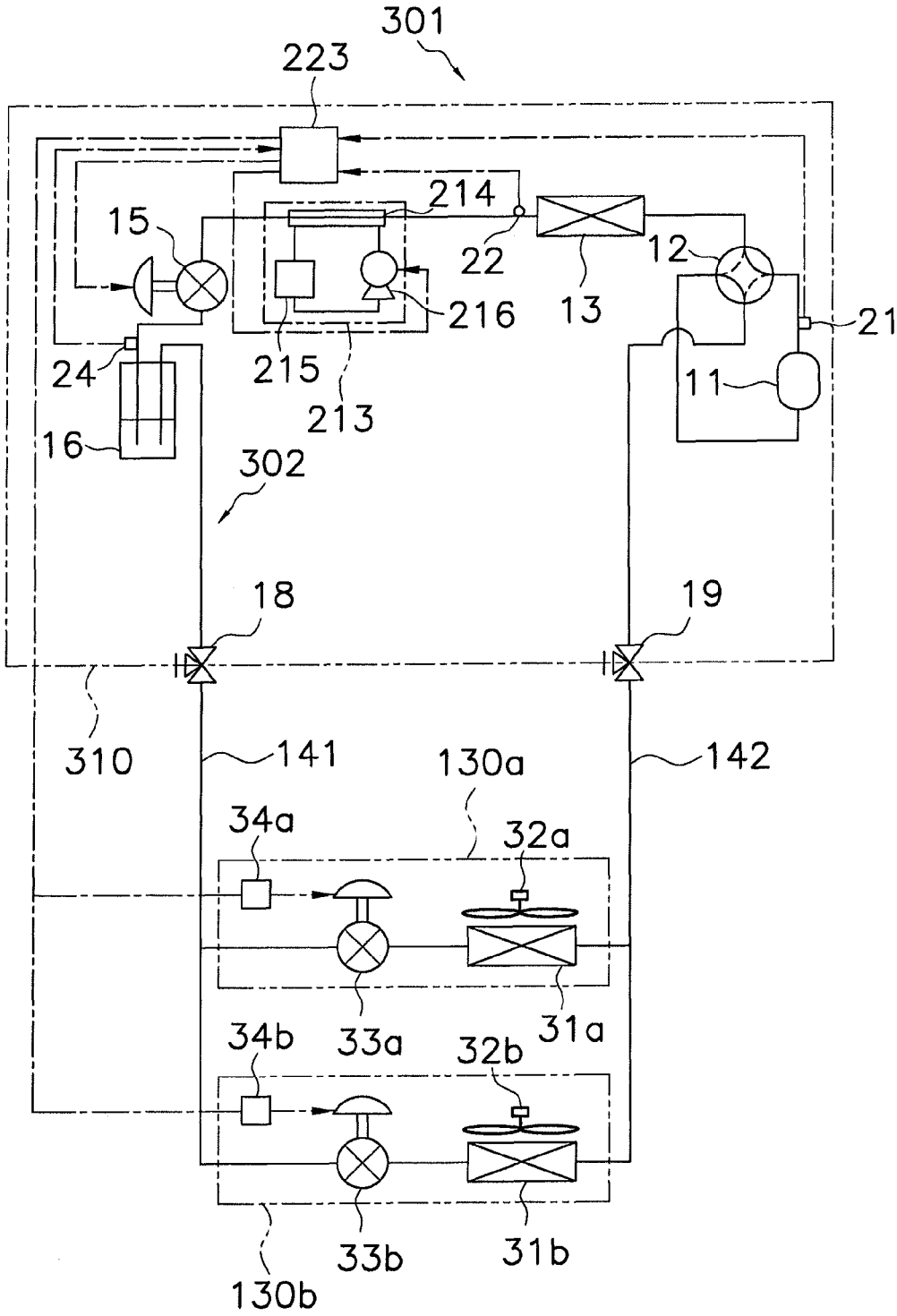
FIG. 6 is a diagram showing the refrigerant circuit of the (multi-type) air conditioning device according to Modification (D).

In FIG. 5, the same reference numerals are used to refer to components that are the same as those of the air conditioning device 1 according to the embodiment described above. The additional reference numerals 201, 202, 210, and 223 refer to the air conditioning device, the refrigerant circuit, the outdoor unit, and the control device, respectively. This technique may also be applied to a multi-type air conditioning device 301 (see FIG. 6) in the same manner as in Modification (A). The same reference numerals are used in FIG. 6 to refer to components that are the same as those of the air conditioning devices 1 and 101 according to the abovementioned embodiment and Modification (A), respectively. The additional reference numerals 302 and 310 refer to the refrigerant circuit and the outdoor unit, respectively.

(E)

The high-pressure sensor 21 is provided to the discharge side of the compressor 11 in the air conditioning device 1 according to the embodiment described above, but the high-pressure sensor 21 may also be omitted. In this case, the degree of opening of the first electric expansion valve 15 and the second electric expansion valve 17 may be controlled so that the state of the refrigerant that has flowed out from the first electric expansion valve 15 is on the saturation line, and so that the pressure of the refrigerant is then equal to or lower than the pressure of {critical pressure (MPa)−0.3 (MPa)} when the temperature obtained from the temperature sensor positioned on the low-temperature side (or liquid side) of the outdoor heat exchanger 13 is equal to or above a predetermined temperature. At this time, it is necessary to provide a temperature sensor between the refrigerant outflow side of the first electric expansion valve 15 and the refrigerant inflow side of the second electric expansion valve 17 to measure the intermediate temperature, and to measure the intermediate pressure through the use of the intermediate-pressure sensor 24.

(F)

In the air conditioning device 1 according to the embodiment described above, the internal heat exchanger 14, the first electric expansion valve 15, the liquid receiver 16, the second electric expansion valve 17, and other components are disposed in the outdoor unit 10, but the positioning of these components is not particularly limited. For example, the second electric expansion valve 17 may be disposed in the indoor unit 30.

(G)

An electric expansion valve is used as the means for reducing the pressure of the refrigerant in the air conditioning device 1 according to the embodiment described above, but an expansion device or the like may instead be used.

(H)

The intermediate-pressure sensor 24 is provided in the air conditioning device 1 according to the embodiment described above, but the intermediate-pressure sensor 24 may be omitted when the high-pressure and the entry temperature of the first electric expansion valve 15 are fixed. In this case, a temperature sensor may be provided between the refrigerant outflow side of the first electric expansion valve 15 and the refrigerant inflow side of the second electric expansion valve 17 to measure the saturation temperature.

(I)

The intermediate-pressure sensor 24 is provided in the air conditioning device 1 according to the embodiment described above, but the intermediate-pressure sensor 24 may be omitted when a low-pressure sensor is provided between the exit side of the indoor heat exchanger 31 and the intake side of the compressor 11, and a temperature sensor is provided near the entrance of the first electric expansion valve 15. In this case, the intermediate pressure is predicted using the degree of opening/differential pressure characteristic of the first electric expansion valve 15 and the second electric expansion valve 17.

(J)

The temperature sensor 22 is provided in the vicinity of the port on the low-temperature side (or liquid side) of the outdoor heat exchanger 13 in the air conditioning device 1 according to the embodiment described above, but the temperature sensor 22 may also be provided in the vicinity of the port of the first electric expansion valve 15 that is on the side of the internal heat exchanger.

Industrial Applicability

The refrigeration device of the present invention has the characteristic of being capable of preventing the refrigerant from reaching a state near the critical point when the refrigerant is expanded to a state near the saturation line by the first expansion mechanism, and the refrigeration device of the present invention is particularly useful as a refrigeration device that uses carbon dioxide or the like as the refrigerant.

What is claimed is:

1. A refrigeration device comprising:

a compression mechanism configured to compress a refrigerant;

a radiator connected to a refrigerant discharge side of said compression mechanism;

a first expansion mechanism connected to an exit side of said radiator;

a refrigerant cooling unit disposed between the exit side of said radiator and a refrigerant inflow side of said first expansion mechanism;

a liquid receiver connected to a refrigerant outflow side of said first expansion mechanism;

a second expansion mechanism connected to an exit side of said liquid receiver;

an evaporator connected to a refrigerant outflow side of said second expansion mechanism and to a refrigerant intake side of said compression mechanism;

a high-pressure sensor provided to the refrigerant discharge side of the compression mechanism;

a temperature sensor provided in a vicinity of the exit side of the radiator;

an intermediate-pressure sensor provided between the first expansion mechanism and the liquid receiver; and a control unit configured to perform refrigerant cooling control, the control unit including a control switching section for switching between the refrigerant cooling control and normal control, the control unit controlling a degree of opening of the first and second expansion mechanisms during the normal control so that a COP is enhanced, and the control unit controlling refrigerant cooling by the refrigerant cooling unit during the refrigerant cooling control by controlling the degree of opening of the first and second expansion mechanisms based on at least a pressure detected by the intermediate-pressure sensor so that the refrigerant that has flowed out of the first expansion mechanism is in a state near the saturation line and at a pressure equal to or less than a critical pressure minus 0.3 MPa.

2. The refrigeration device according to claim 1, wherein said refrigerant cooling unit is an internal heat exchanger configured to exchange heat between refrigerant that flows to a first refrigerant pipe and refrigerant that flows to a second refrigerant pipe, said first refrigerant pipe connecting the exit side of said radiator and the inflow side of said first expansion mechanism, and said second refrigerant pipe connecting the exit side of said evaporator and the refrigerant intake side of said compression mechanism.

3. The refrigeration device according to claim 2, further comprising:

a temperature detector provided in a vicinity of the exit of said radiator or in a vicinity of a refrigerant inflow port of said first expansion mechanism, said control unit being further configured to perform said refrigerant cooling control when a temperature detected by said temperature detector is equal to or above a predetermined temperature.

4. The refrigeration device according to claim 1, further comprising:

a temperature detector provided in a vicinity of the exit of said radiator or in a vicinity of a refrigerant inflow port of said first expansion mechanism, said control unit being further configured to perform said refrigerant cooling control when a temperature detected by said temperature detector is equal to or above a predetermined temperature.

* * * * *